US007013584B2

(12) United States Patent
Vindriis

(10) Patent No.: US 7,013,584 B2
(45) Date of Patent: Mar. 21, 2006

(54) SHOCK ABSORBING AND PRESSURE REDUCING INSOLE

(76) Inventor: Søren Vindriis, Tulipanparken 43, DK-8700 Horsens (DK)

( * ) Notice: Subject to any disclaimer, the term of this patent is extended or adjusted under 35 U.S.C. 154(b) by 2 days.

(21) Appl. No.: 10/398,316

(22) PCT Filed: Sep. 27, 2001

(86) PCT No.: PCT/DK01/00615

§ 371 (c)(1),
(2), (4) Date: May 6, 2003

(87) PCT Pub. No.: WO02/28216

PCT Pub. Date: Apr. 11, 2002

(65) Prior Publication Data

US 2003/0172549 A1 Sep. 18, 2003

(30) Foreign Application Priority Data

Oct. 6, 2000 (DK) ..... 2000 01487

(51) Int. Cl.
*A43B 13/20* (2006.01)

(52) U.S. Cl. ..... 36/29

(58) Field of Classification Search ..... 36/29, 36/44, 153, 154
See application file for complete search history.

(56) References Cited

U.S. PATENT DOCUMENTS

| | | | | |
|---|---|---|---|---|
| 2,645,865 | A | 7/1953 | Town | |
| 3,765,422 | A | 10/1973 | Smith | |
| 3,990,457 | A | 11/1976 | Voorhees | |
| 4,115,934 | A | 9/1978 | Hall | |
| 4,123,855 | A | 11/1978 | Thedford | |
| 4,155,934 | A | 5/1979 | Kalopissis et al. | |
| 4,567,677 | A | 2/1986 | Zona | |
| 5,067,255 | A | 11/1991 | Hutcheson | |
| 5,131,174 | A | 7/1992 | Drew et al. | |
| 5,313,717 | A * | 5/1994 | Allen et al. | 36/28 |
| 5,595,004 | A | 1/1997 | Lyden et al. | |
| 5,778,561 | A | 7/1998 | Shimoyama | |
| 5,878,510 | A | 3/1999 | Schoesler | |
| 5,979,086 | A | 11/1999 | Vindriis | |

FOREIGN PATENT DOCUMENTS

| | | |
|---|---|---|
| EP | 0780064 | 6/1997 |
| WO | WO 9423603 | 10/1994 |

* cited by examiner

*Primary Examiner*—Ted Kavanaugh
(74) *Attorney, Agent, or Firm*—Ladas & Parry LLP

(57) ABSTRACT

Shock absorbing and pressure reducing insole for footwear with one or several cavities filled with fluid. In the cavity, additional joints have been provided between the top foil and the bottom foil of the insole in order to damp the movement of the fluid in the insole. The additional joints have varying heights in order to promote presence of fluid near the higher joints.

11 Claims, 7 Drawing Sheets

SHOCK ABSORBING AND PRESSURE REDUCING INSOLE

This application is a 371 of PCT/DK01/00615 filed Sep. 27, 2001.

BACKGROUND OF THE INVENTION

The present invention relates to a shock absorbing and pressure reducing insole as that comprises a top foil and a bottom foil joined with first joints along a closed path to provide at least one enclosed cavity, which is filled with at least one fluid, wherein in said enclosed cavity, additional joints are provided. The invention also relates to a process of manufacturing as well as to use of an insole.

A larger number of insoles for footwear are known, where the insole is filled with a fluid, for example gas, liquid or gel. Typically, the insole is manufactured by joining, for example welding or gluing, two foils together along the edge of the insole. Thus, an enclosed cavity is produced which is filled with fluid before or during the joining.

Apart from the joint along the edge, the insole can be provided with additional joints in a particular pattern in order to obtain a massaging or pressure reducing effect.

Such soles are described in international patent application WO 94/23603 and in U.S. Pat. Nos. 4,123,855, 5,778,561, 5,979,086, 4,567,677 and 5,067,255. These massaging insoles are characterised in that one or several liquid cavities are provided extending from the rear of the insole to the front of the insole. The massaging effect arises as a result of the movement of the liquid in-between the heel area and the area under the forefoot as the load on the foot is changed. These soles may be provided with joint patterns designed to obstruct the movement of the liquid, which prolongs the response time of the sole, thus, creating a shock absorbing effect. Furthermore, joints on the insole under the middle of the foot prevent the liquid from gathering at this particular place. The disadvantage of these soles is that a continued load on the heel or forefoot will cause the liquid to flow to the opposite end of the insole, thus, removing the supporting liquid from under the heel and forefoot, respectively.

In order to maintain the liquid support under the heel and forefoot, respectively, an insole has been developed and described in U.S. Pat. No. 4,115,934, in which an insole has been provided with smaller cavities under the heel and under the forefoot. However, such a construction has great disadvantages. Through a load placed such on a cavity, which for example is established centrally under the heel, the liquid will be displaced from the centre to the periphery of the cavity. This principle is not appropriate for thin insoles because all the liquid is displaced from the middle of the cavity to the periphery due to loading. This effect is increasingly significant by long term use, as a repeated load causes so-called creep of the foil material, which results in an easier displacement of the liquid to the periphery of the cavity. Consequently, load by the heel will cause the absence of liquid under the heel. This effect can be counteracted by using very thick insoles, where the cavities contain a large amount of fluid, or where part of the liquid is substituted by a sponge material as in U.S. Pat. No. 5,313,717. However, thick insoles can be difficult to fit into existing footwear. Furthermore, a high, liquid filled insole diminishes the support of the foot by the footwear.

Another disadvantage is that load by the heel causes the liquid to flow from the middle of the heel area to the periphery of the heel cavity within a very short time, whereby the shock absorption is limited considerably. Also, the well known long-term problem of creep of the material has the effect that both shock absorption and pressure reduction decrease substantially with time. In addition to this, the displacement of the liquid to the periphery of the cavity causes problems for larger supporting areas under for example the heel, because that peripheral area also extends across the foot close to the heel bone, where, consequently, a bead of liquid will press up against the tendons and muscles of the foot, which is very uncomfortable and painful. The same effect will arise under the forefoot, where the liquid bead will settle itself especially in the transitional area between the sole of the foot and the toes. Therefore, commercially available insoles only have cavities with very limited supporting areas.

There is a substantial demand for large pressure reducing surfaces in footwear, especially within the orthopaedic field, for example where an effective relief of the entire heel area is necessary in the case of heel spur. Correspondingly, flatfootedness of the forefoot is best solved by a large pressure reducing surface. Furthermore, with shock absorption being a function of collision time and collision area, a large surface will provide a better shock absorption.

SUMMARY OF THE INVENTION

It is the purpose of the invention to provide an insole that is shock absorbing and at the same time pressure reducing, and where known disadvantages are avoided. In particular, it is the purpose of the invention to provide a thin insole with improved high shock absorbing and pressure reducing properties.

This purpose is achieved with a shock absorbing and pressure reducing insole for footwear, of the type wherein said insole comprises a top foil and a bottom foil joined along a closed path to provide at least one enclosed cavity, which is filled with at least one fluid, wherein in said enclosed cavity, additional joints are provided which is characterised in that said additional joint have varying heights for promoting presence of liquid near the higher of said additional joints as described in the characterising part of claim 1.

With an insole according to the invention, a support of the foot is achieved through one or more enclosed cavities around those areas where a load is exerted by the foot, for example in the heel area or in the area under the forefoot. To prevent that, due to continuous load by a part of the foot, for example the heel, there no longer is fluid, for example gas, liquid or gel, under this particular part of the foot, these cavities are established in such a manner that they do not extend from the rear of footwear to the front of the footwear, thus preventing the liquid from being displaced from the rear of the footwear to the front of the footwear.

In the following, the invention will be explained with focus on the areas around the heel and the forefoot, although it is within the scope of the invention that enclosed cavities can be established under other parts of the foot, if this should be appropriate.

The insole according to the invention is provided with additional joints in such an enclosed cavity. These joints are preferably established along open paths. The term open path is used for paths that are not closed, which means that the establishment of these joints does not result in new enclosed fluid containing cavities. The simplified term open path implies not only elongated paths, but also point-like joints. Through these additional joints, a number of advantages is achieved, which will be described in the following.

As experiments have shown for thin insoles that shall fit into existing footwear, it is of great advantage that the additional joints are of varying height. In this situation, the fluid inside the insole can be concentrated in particular places by locating higher additional joints in the vicinity of those places. For example, it is preferred that the joints closest to the pressure area are the highest in order to promote the presence of liquid in the pressure area when no load by the foot is put on this particular place.

Such a joint is easily obtained when welding is used for the joining. Through welding, the foil material is melted and pushed towards the edge of the welding seam. By pushing the welding seam more closely together at one location that at another, for example by repeated welding at the same location, an edge on the welding seam is obtained at that place which is higher than at the other.

Through load, the liquid is displaced from these areas and pressed into the areas surrounding the joints, where the cavity of the insole is thin due to lower additional jointsTherefore, the liquid will do work in order to push the top foil and the bottom foil apart close to these lower joints. Thus, the liquid is prevented from flowing quickly, which increases the collision time as well as the collision area. Furthermore, the liquid will always adapt to the individual foot shape and the load by the bone, regardless of the angle with which the foot is placed on to the base surface and regardless of the design of the inner sole of the shoe, which in total provides an optimal shock absorption.

While a shock absorption, as mentioned above, is achieved in the case of a momentary load, a continuous load will have a pressure reducing effect, because the liquid will shape the insole to match the contours of the foot, for example under the heel.

An insole according to the invention does not have the same problem as known insoles where the liquid in for example a round cavity under the heel due to load is pushed from the middle of the cavity to the periphery of the cavity with the effect that the heel no longer is supported by liquid. According to the invention, the additional joints can be established in such a manner that they prevent the cavity from becoming too thick at the periphery, thus, constantly maintaining part of the liquid inside the area where the foot causes the biggest pressure. Therefore, the desired pressure reducing effect is maintained and at the same time the harmful transverse bead is avoided. As a result, an insole according to the invention can be manufactured very thin and still maintain the desired shock absorbing and pressure reducing effect.

Furthermore, the additional joints have the effect that the structure of the insole is more stable than that of other known products, because the top foil and the bottom foil are joined in many places and not just along the edge. This implies that the pressure of the liquid, when a load is placed on it, is distributed along a much longer welding seam, which may be the sum of a plurality of point-like welding seams, so that the load per unit of length of the welding seam is strongly reduced, thus increasing the strength of the sole in accordance with the number and length of additional joints. At the same time, another great advantage is achieved, namely that creep does not occur to the same degree as in soles according to prior art.

Advantageously the additional joints are established in an area outside a pressure area, where the pressure area is that area under the heel or forefoot, respectively, which is subject to the greatest pressure from the heel or forefoot, respectively. This ensures that the insole is relatively high in the pressure area with a good absorbing and pressure reducing effect.

An insole according to the invention has proved suitable for the containment of liquid or gas under a higher pressure than atmospheric pressure. This has not been possible in the same way with known soles. In this connection, the additional joints, which prevent the surface of the insole from curving too much, are crucial. By using a higher pressure than in similar soles according to prior art, the insole can be manufactured very thin and still provide a very powerful shock absorption and a heavily pressure reducing effect, which normally only can be achieved with much thicker constructions. Using thin insoles has the advantage that these fit into the existing footwear, thus, improving the already existing footwear of the user considerably. Furthermore, this causes the user to feel a high degree of stability from the footwear, which is not always implicit if the insole is very thick, because the top foil of thick, liquid filled insoles tends to slide sideways with respect to the bottom foil and the outer sole of the footwear.

Generally, it is a big problem to manufacture insoles where the fluid has a pressure that is above that of the atmosphere, because the joining according to prior art has to take place in a pressurised chamber. Alternatively, according to prior art, the joining takes place first after the cavities are filled with fluid under pressure, which also is a very difficult and expensive process. This is why insoles with fluid under excess pressure have not been commercially available although they offer many advantages.

However, it has been proven that the production of additional joints in an insole according to the invention can be used as a very simple and economic way of creating excess pressure of the fluid in an insole according to the invention. As a first step, a top foil and a bottom foil are joined along a closed joining path in order to create an enclosed cavity, where the cavity is filled with a certain amount of fluid under atmospheric pressure. This first step is well-known. In the next step, which is unique for the invention, additional joining paths are established in the enclosed cavity, primarily through welding, along open paths in order to reduce the volume of the enclosed cavity. Hereby, a pressure which is above atmospheric pressure is obtained in the cavity. The more of the additional joints that are established, the smaller is the volume of the enclosed cavity and the higher is the pressure in the cavity.

It is generally known that the majority of problems with pain under the heel or the forefoot are a result of the body weight being concentrated on very small areas on the sole of the foot, which causes painful concentrations of pressure. Today, these problems are sought solved orthopaedically by modelling a firm, thick insole which through geometrically elevated areas against the sole of the foot seeks to move some of the mentioned concentration of pressure to other parts of the foot. However, these insoles have many disadvantages of which can be mentioned: They alter the positioning of the foot by forcing the foot to place a bigger load on the outer edge of the foot, which with time often causes problems with knees, hips and the back; they prevent a natural movement of the foot, because the foot is forced into only one positioning, which on the one hand often is uncomfortable and on the other hand reduces the blood circulation in the foot; they require space, which means that the user is forced to buying very expensive shoes, combined with the fact that these shoes are far from fashionable, particularly in the opinion of women, which is a real problem to many women. In addition, those insoles themselves are very expensive. Regarding the economic aspect, it is important to be aware of the fact that, once the use of these firm insoles is commenced, the additional expenses to both shoes and insoles will be permanent for the rest of the user's life.

Through the pressure reducing effect, an insole according to the invention is highly pain reducing. Furthermore, the additional joints are easily arrangeable in a manner to relieve the given pain areas in the best possible way, which in most cases will have the effect that the insole is of greater aid than the insoles known today. This is combined with the fact that the pressure reducing effect from the given pressure area of the sole always follows the individual foot shape dynamically during every thinkable foot movement, especially since the pressure reducing areas according to the invention can be established with a large area. Furthermore, the insole does not alter the natural positioning of the foot, thereby preventing a harmful load on knees, hips and back; the insole does not lock the foot movement, whereby the blood circulation in the foot is not reduced; the insole is thin, whereby the insole fits into the normal shoes of the user, even into ladies' shoes with high heels, which offers a very great advantage for the user both in comfort and financially.

The insole has proven particularly advantageous for sports shoes. In the field of sports, maximal performance is generally desired. In relation to sports shoes, this translates into the demand for maximal shock absorption and best possible fit in relation to the inner sole of the shoe, such that the load receiving areas under the heel and forefoot are as large as possible. As a rule, shock absorption is achieved through elastomers. Elastomers are, however, relatively heavy, which is why the construction of sports shoes always involves a compromise between the desired shock absorption and the weight of the shoe, as a shoe that is too heavy reduces the performance of the athlete.

In many disciplines, such as sprinting, basketball or tennis, specially moulded insoles are manufactured for the individual top athlete, where the insole increases the loadable area as much as possible in order to increase the collision area, thus, increasing the use of the shock absorbing properties of the elastomers and reducing the weight of the shoes. Intrinsically, moulded insoles only have one form, which means that they never are able to follow all the movements of the foot. In particular, it is difficult to shape the insoles optimally in relation to the angle with which the foot is placed onto the base surface, since this angle is dependent on both the speed of the athlete and the condition of the base surface.

Through the containment of fluid and the physical laws for fluid motion in the enclosed cavities, the insole according to the invention will always adapt to the individual dynamic foot shape of the athlete. This means that the insole always will provide the largest possible collision area regardless the foot shape of the athlete, the inner sole of the shoe, the angle with which the foot is placed onto the base surface and the properties of the base surface. Additionally, the very small weight of the thin insole makes it particularly suited for sports. As a result, it is possible to make insoles for general sports shoes which correspond to and are much better than those insoles that are shaped individually for top athletes today. This is combined with the fact that it is possible to adapt the enclosed cavities and the additional joints to top athletes, such that the insole offers the possibility of shock absorption and dynamic relief at a previously unknown level.

The fluid for an insole according to the invention may comprise two or more liquids with different viscosity in order to optimise the shock damping properties. Also the fluid may contain small solid or elastic spheres, for example filled with gas in order to reduce the weight of the insole. Also particles may be suspended in the fluid in order to adjust flowing and damping properties. For example, liquids with colloidal particles are known to change viscosity in dependence of mechanical action exerted on the liquid.

DESCRIPTION OF THE DRAWING

In the following the invention is described in more detail with reference to the drawing where.

DETAILED DESCRIPTION/PREFERRED EMBODIMENT

Figure 1:
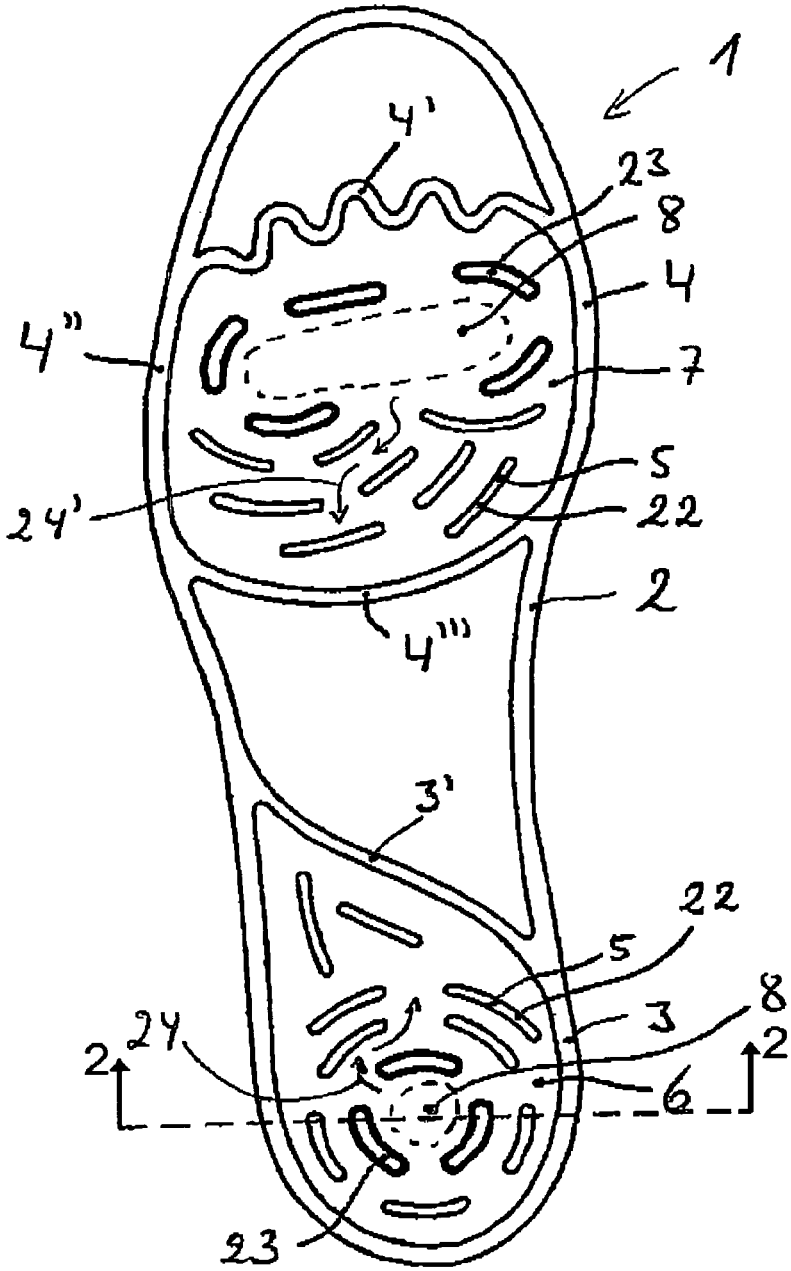
FIG. 1 shows an insole as seen from a direction normal to the surface.

FIG. 1 shows an insole 1 as seen from a direction normal to the surface. The top foil and bottom foil are joined, for example by gluing, hot welding or ultrasound welding, along the edge 2 of the insole 1. Furthermore, an fluid filled cavity 6 is provided at the area under the heel through enclosure by a first closed path 3, 3'. A second fluid filled cavity 7 is provided in the area under the forefoot through enclosure by a second closed path 4, 4', 4", 4'". In these two cavities 6, 7, additional joints 5 have been provided along open paths.

As illustrated in FIG. 1, the additional joints 5 have been provided in an area outside a pressure area 8', 8, which is indicated with a hatched curve. The pressure area is on the one hand that area 8 under the heel, which is subjected to the highest pressure from the heel, and on the other hand that area 8' under the forefoot, which is subject to the highest pressure from the forefoot.

Furthermore, the additional joints 5 may be arranged in a pattern which impedes the free movement of the fluid in the cavity 6, 7. When the cavity 6, 7 is subjected to a load which causes the fluid to be displaced from pressure area 8, 8", the narrowed passages between the additional joints 5 will damp the movement of the fluid, where the movement is indicated with curved arrows 24, 24'.

Figure 2A:
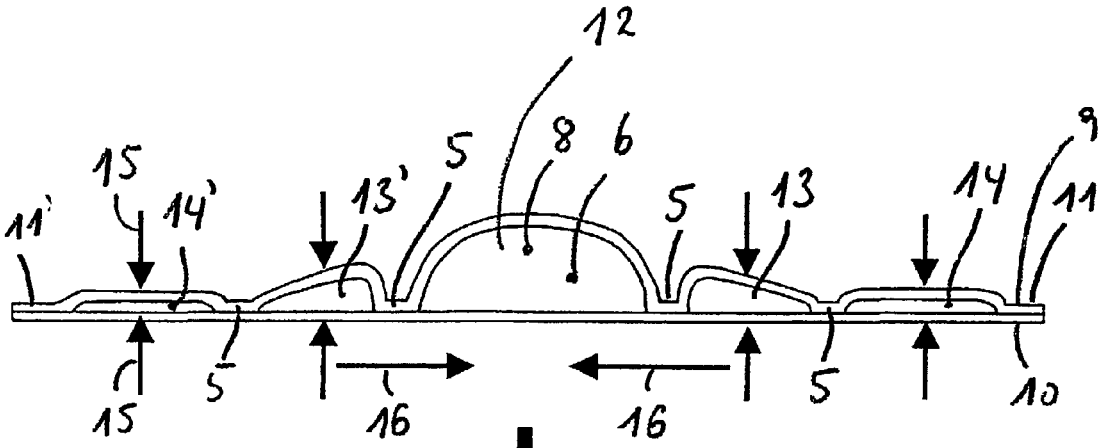
FIGS. 2*a*–2*c* show a cross section of the insole along the line 2—2.

FIG. 2 shows a cross section through the insole 1 along the line 2—2 as indicated in FIG. 1. If the insole 1 is not under the load of a foot, the insole 1 will be shaped as shown in FIG. 2*a*. At the outer edge 11, 11' of the insole 1, the top foil 9 and bottom foil 10 are joined. Furthermore, cavity 6, enclosed by the outer edge 11, 11', has additional joints 5. In the middle of the cavity 6, the pressure area 8 is situated. The outer areas 13, 13', 14, 14' are not as high as middle area 12, because the additional joints 5 and the elasticity of the foils 9, 10 prevent this. The shape of the outer areas 13, 13', which are shown asymmetrically in FIG. 2*a*, are determined by the design of the additional joints. Due to elastic forces, illustrated with arrows 15, between top foil 9 and bottom foil 10, the fluid is caused to flow to the middle area 12, which is illustrated with arrows 16.

Figure 2B:
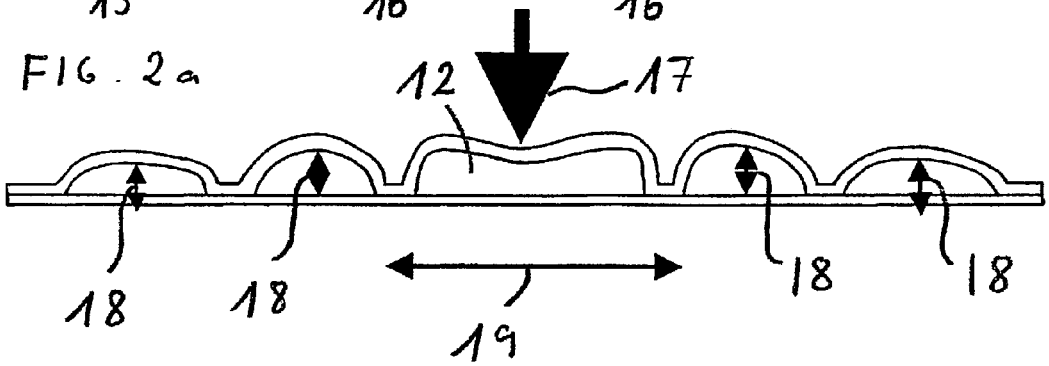

FIG. 2*b* illustrates the consequence of an external shock with pressure 17 on insole 1. The middle area 12 is then pressed together. The pressure will transmit to the remaining fluid, indicated with arrows 19, causing the outer areas 13, 13', 14, 14' to expand, which is indicated with arrows 18. During this expansion, a mechanical work is performed by pushing the of top foil 9 away from the bottom foil 10, which results in an absorption of the shock.

Figure 2C:
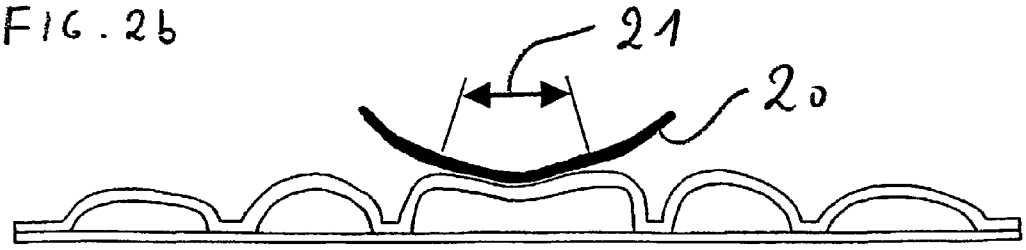

FIG. 2*c* illustrates how a very local load, as shown in FIG. 2*b*, causes a pressure reduction in a very large area 21 under the heel 20.

Figure 3A:
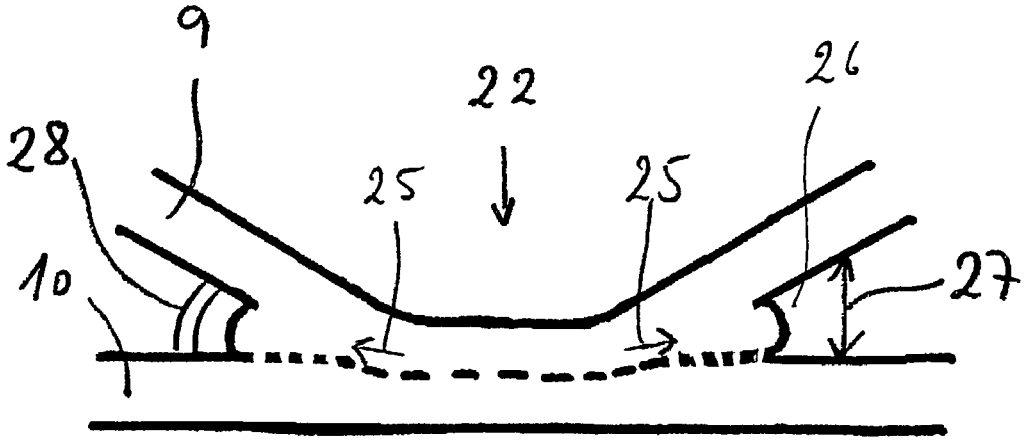
FIGS. 3*a* and 3*b* illustrate weldings of different height.

FIG. 3 illustrates weldings 22, 23 of different heights. In the first welding 22, the top foil 9 and the bottom foil 10 are joined with a relatively small change in the thickness of the foil at the position of the welding seam, which is shown on FIG. 3*a*. Only very little material has therefore been pushed to the edge 26 as indicated with arrows 25. Because of the small angle 28 between the top foil 9 and the bottom foil 10, the height 27 of the insole, therefore, will be relatively small at a distance from the edge, which is why this type of welding results in a low joint.

Figure 3B:
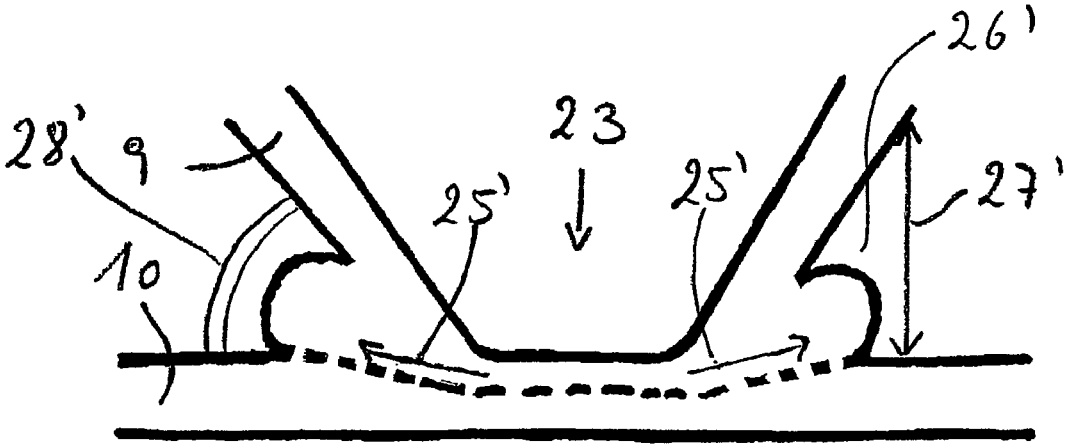

FIG. 3*b* shows a so-called deep welding 23. The foil thickness has changed substantially and, therefore, much more material has been pushed to the edge 26' as indicated with arrows 25'. Because of the steep angle 28' between the top foil 9 and the bottom foil 10, the height 27' of the insole will thus be relatively big at a distance from the edge 26' of joint 23, which is why this type of welding results in a high joint.

By applying this technology, it is possible to design and manufacture an insole according to the invention with a relatively large amount of fluid in preferred areas. It is thus advantageous to vary the height of the additional joints 5, preferably the height 28, 28' of the welding 22, 23 such that the joints due to the weldings 23 closest to the pressure area 8, 8' are the highest in order to promote the presence of fluid in pressure area 8', 8 when this area is not loaded by the foot.

Figure 6:
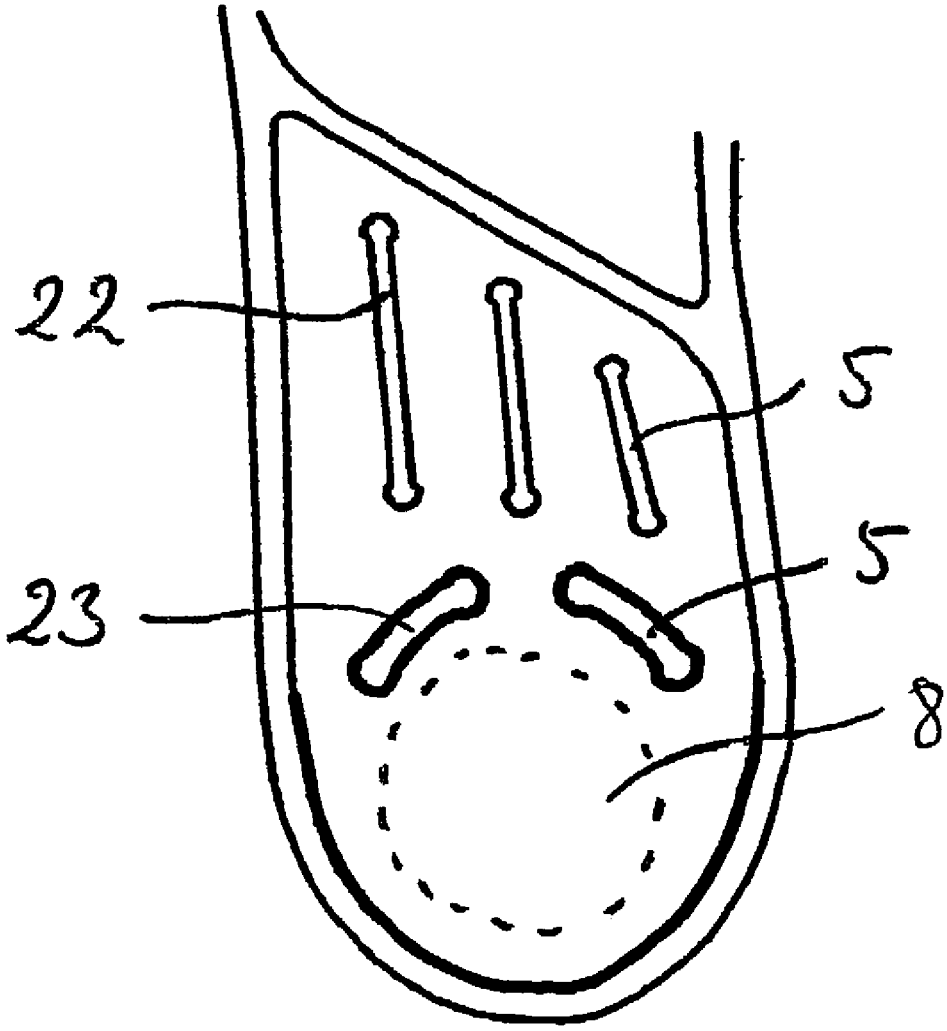
FIG. 6 shows another embodiment with a large relief area at the heel.

The high joints due to deep welding 23 and the low joints due to the first type of welding 22 are also indicated in FIG. 1 and FIG. 6 for illustration.

Figure 4A:
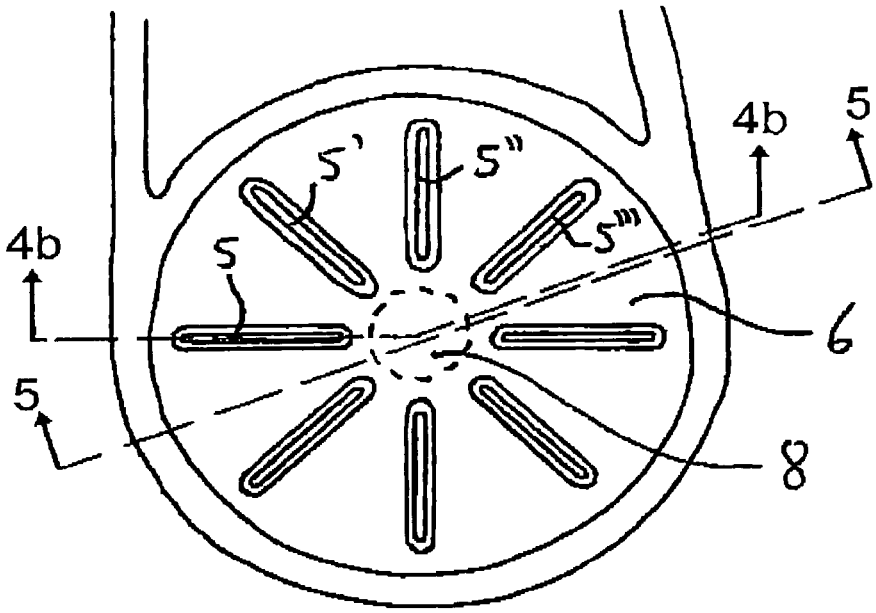
FIG. 4*a* illustrates a different embodiment of an enclosed cavity in the heel area.
Figure 4B:
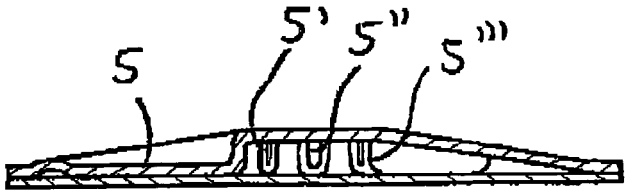
FIG. 4*b* shows the cross-section 4*b*—4*b* through the cavity at the level.

FIG. 4 illustrates another, embodiment of an enclosed cavity 6 in the heel area. The additional joints 5 extend radially from pressure area 8 and decrease in height with distance from the pressure area. This is illustrated in FIG. 4*b*, where the insole is shown in a cross section along the line 4*b*-46 with the perspective being towards the front of the insole so that the additional joints 5', 5", 5'" are visible as well. In this connection, it has to be pointed out that for purpose of simplification, the varying height of the additional joints is not illustrated in FIG. 4*b*. As the additional joints 5 decrease with distance from the pressure area 8, the fluid will be concentrated in the pressure area 8.

Figure 5:
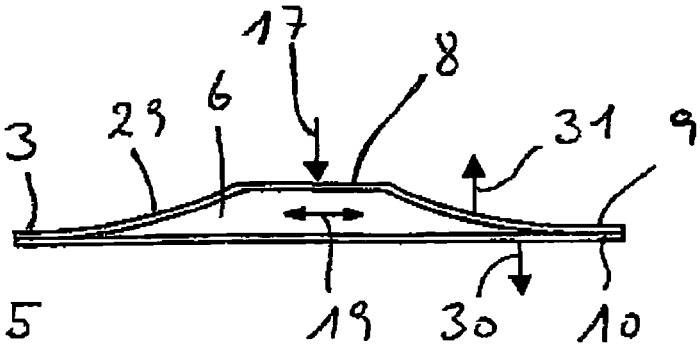
FIG. 5 shows the cross section 5—5 through the cavity at the heel area.

The profile of the enclosed cavity in the cross section along line 5—5 is illustrated in greater detail in FIG. 5. Because of the additional joints 5 that extend radially, the profile is flat in the pressure area 8 when lacking the influence of external pressure and concave in area 29 extending from pressure area 8 and to the edge 3. The concave shape, as opposed to a convex shape, ensures the largest possible amount of fluid in pressure area S. Furthermore, the concave shape causes a damping of the shock. This is illustrated in FIG. 5. When loaded 17, the fluid will be pressed away from pressure area 8, as indicated with arrows 19, causing the top foil 9 and the bottom foil 10 to be pushed apart. The force 30 directed downwards from the bottom foil 10 will be transferred to the footwear, whilst the force 31 directed upwards in the top foil 9 will result in an elastic deformation of cavity 6. This deformation is achieved by the mechanical work performed by the liquid on the insole, whereby the mechanical energy caused by the shock is absorbed. As a consequence of the concave shape of area 29, which enables the largest possible amount of fluid to be available in pressure area 8 before the shock, a relatively large amount of fluid must be displaced almost instantaneously from the pressure area. This causes the shock absorption and pressure reduction by an insole 1 according to the invention to be far better than by insoles known thus far.

FIG. 6 shows an alternative embodiment of an insole according to the invention where the pressure area 8 is chosen to be relatively large.

Figure 7A:
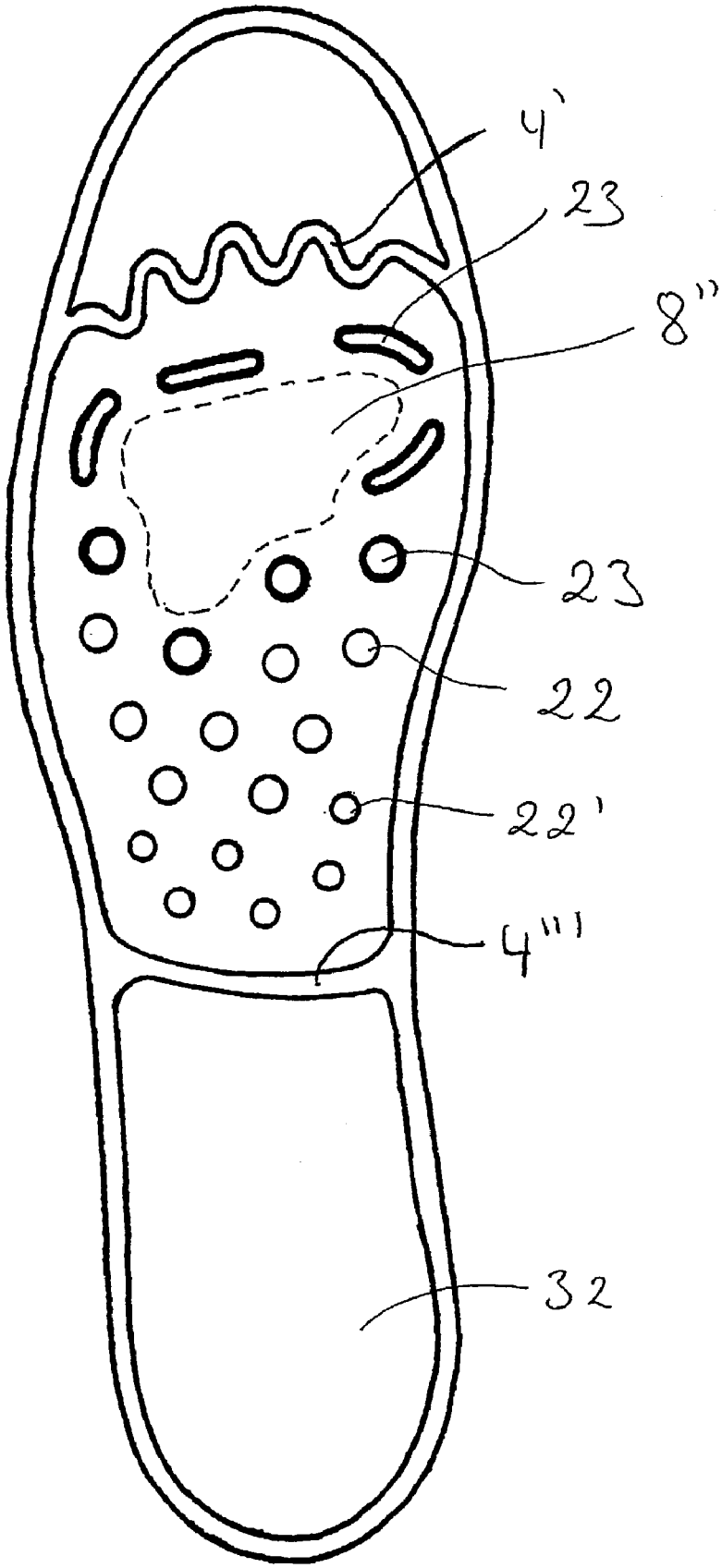
FIGS. 7*a* and 7*b* show another embodiment where the additional joints are placed in accordance with individual shock absorption.
Figure 7B:
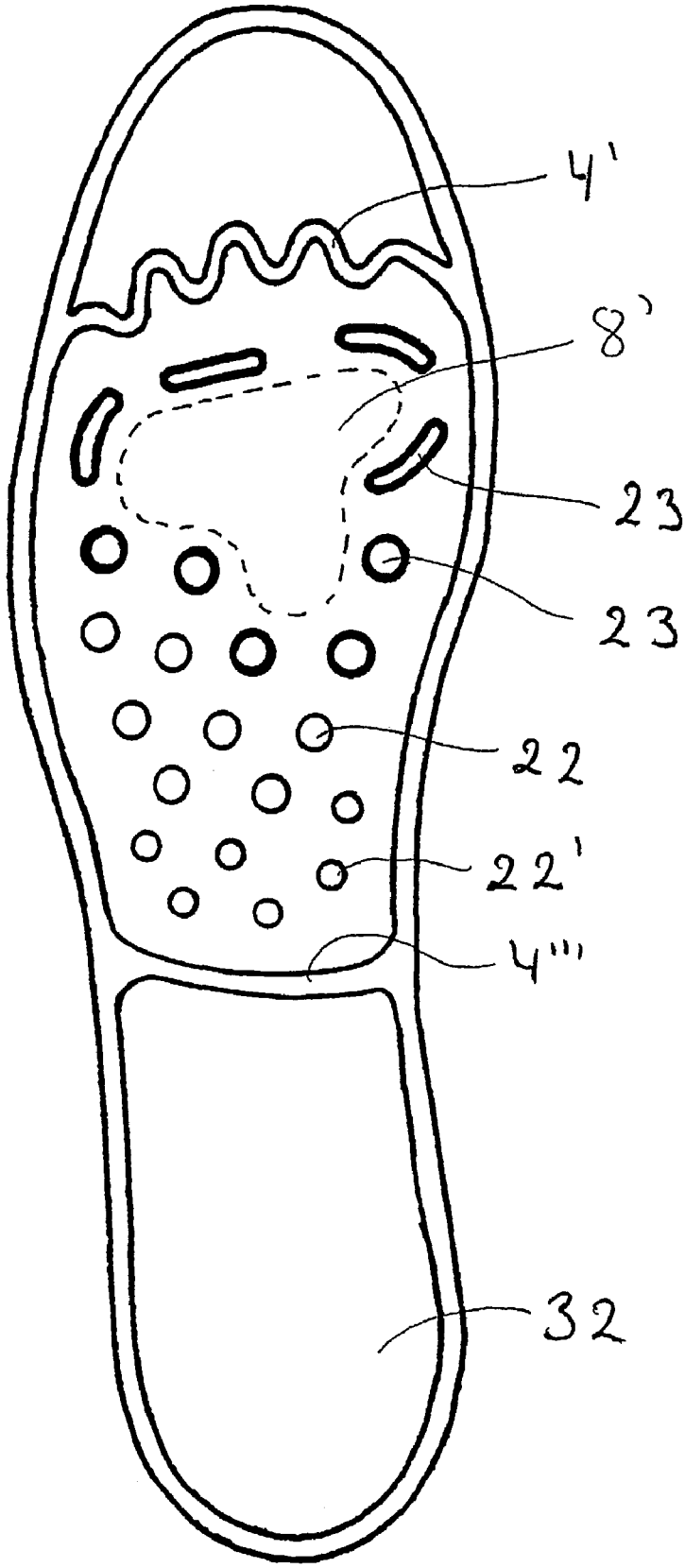

FIGS. 7*a* and 7*b* illustrate two cases, where the shock absorbing and pressure reducing area 8', 8" are individually shaped for two different users. High joints 23 are indicated with thicker outlines. An insole according to the invention allows a very simplified optimisation of an individual insole. The insole may be manufactured without additional low joints 22 and high joints 23 after which in accordance with the need of the user, additional joints are welded into the insole in such a manner as to form the pressure area 8', 8" and to adjust the flow speed through the flow restricting joints 22, 23. Also by forming the joints, the pressure inside the sole may be adjusted to be optimum for the user, for example the sportsman.

On FIGS. 7*a* and 7*b*, the additional low joints 22, 22' have different sizes, which also is a factor in the optimisation process. The total reservoir of fluid extends from the front welding 4' to the rear welding 4'", which is located under the arch of the foot, where minimum pressure is applied. In practice, the insole may be truncated, for example by cutting, along the rear welding 4'" in order to obtain a short insole only for the forefoot. This truncation may be performed by the user after purchase of the insole in order to fit the insole into footwear, for example a ladies' summershoe. In this case, the rear part 32 may be without fluid inside. Likewise, only a rear part of the insole may be used by the user for shock absorption from the heel. Such an insole may for example be fastened to the user's shoe by glueing or with sticking tape.

An insole according to the invention is primarily produced with a height of 2 mm, but the insole may have a different height, for example between 0.5 mm and 10 mm.

Though the invention relates to an insole, it is within the capability of the skilled man to use the aspects of the invention in connection with ordinary soles, such as soles for sports shoes or other footwear, bicycle saddles, riding saddles, knee and shin protectors and on band aid against concentrated pressure on the side of the foot and on toes.

What is claimed is:

1. A shock absorbing and pressure reducing insole for footwear, wherein said insole comprises a top foil and a bottom foil joined with first joints along a closed path to provide at least one enclosed cavity, which is filled with at least one fluid, wherein in said enclosed cavity, additional joints are provided as welding seams, wherein said additional joints have varying heights for promoting presence of liquid near the higher of said additional joints, the varying heights of the additional joints are due to a varying amount of foil material between the top foil and the bottom foil at the edge of the welding seam.

2. A shock absorbing and pressure reducing insole according to claim 1, wherein said additional joints are provided only outside a pressure area, wherein said pressure area is that area under the heel that is subjected to the highest load by the heel and/or that area under the forefoot that is subjected to the highest load by the forefoot.

3. A shock absorbing and pressure reducing insole according to claim 2, wherein said additional joints have varying heights and have the greatest height closest to said pressure area in order to promote the amount of fluid in said pressure area.

4. A shock absorbing and pressure reducing insole according to claim 3, wherein the additional joints extend radially from the pressure area and decrease in height with distance from the pressure area.

5. A shock absorbing and pressure reducing insole according to claim 3, wherein the additional joints comprise low joints and high joints, where the high joints are provided nearer to the pressure are area than the low joints.

6. A shock absorbing and pressure reducing insole according to claim 3, wherein said at least one enclosed cavity is delimited to support only a part of the foot and does not extend from the front of said footwear to the rear of said footwear.

7. A shock absorbing and pressure reducing insole according to claim 6, wherein said least one enclosed cavity extends at least partly under the arch of the foot.

8. A shock absorbing and pressure reducing insole according to claim 1, wherein the pressure of said fluid in at least one additional cavity is above atmospheric pressure under load-free conditions.

9. A shock absorbing and pressure reducing insole according to claim 1, wherein said at least one fluid contains hollow spheres or particles suspended in said fluid.

10. A shock absorbing and pressure reducing insole according to claim 1, wherein said at least one fluid comprises two liquids having different viscosity.

11. Method for production of a shock absorbing and pressure reducing insole for footwear according to claim 1, wherein in a first step a top foil and a bottom foil are joined along a closed path to provide an enclosed cavity in which fluid is provided under atmospheric pressure, wherein in a next step additional joints are provided in said enclosed cavity to reduce the volume of said enclosed cavity, thereby providing a pressure in said enclosed cavity which is above atmospheric pressure under load-free conditions.

* * * * *